US009579007B2

(12) United States Patent
Yang et al.

(10) Patent No.: US 9,579,007 B2
(45) Date of Patent: Feb. 28, 2017

(54) DUSTING DEVICE

(71) Applicants: YA-Ching Yang, Taipei (TW); Yi-Jun Pan, Taipei (TW); Pai-Yung Lin, Taipei (TW)

(72) Inventors: YA-Ching Yang, Taipei (TW); Yi-Jun Pan, Taipei (TW); Pai-Yung Lin, Taipei (TW)

( * ) Notice: Subject to any disclaimer, the term of this patent is extended or adjusted under 35 U.S.C. 154(b) by 0 days.

(21) Appl. No.: 14/746,861

(22) Filed: Jun. 23, 2015

(65) Prior Publication Data

US 2016/0029866 A1 Feb. 4, 2016

(30) Foreign Application Priority Data

Jul. 30, 2014 (TW) ..... 103125951 A

(51) Int. Cl.

| | |
|---|---|
| ***A47L 11/162*** | (2006.01) |
| ***A47L 11/40*** | (2006.01) |
| ***A47L 11/08*** | (2006.01) |
| ***A47L 11/16*** | (2006.01) |
| ***A47L 11/14*** | (2006.01) |

(52) U.S. Cl.

CPC ..... *A47L 11/4038* (2013.01); *A47L 11/08* (2013.01); *A47L 11/14* (2013.01); *A47L 11/16* (2013.01); *A47L 11/162* (2013.01)

(58) Field of Classification Search

CPC ..... A47L 11/162; A47L 11/4038

See application file for complete search history.

(56) References Cited

U.S. PATENT DOCUMENTS 1,668,692 A * 5/1928 Miskimen ..... A47L 11/162 15/328
4,701,970 A * 10/1987 Wilson ..... A47L 11/164 15/230.16
7,640,626 B2 * 1/2010 Oh ..... A47L 9/0472 15/321

* cited by examiner

*Primary Examiner* — Randall Chin

(57) ABSTRACT

A dusting device to be rotatably connected to the bottom of a cleaning machine or vacuum cleaner includes a rotary disc and a dusting element. The rotary disc includes a base and a connecting portion below the base. The connecting portion extends outward from the periphery of the base and has a bottom surface forming a pressing plate. The dusting element is detachably assembled to the connecting portion of the rotary disc in order to be pressed by the pressing plate. The dusting element includes at least one cleaning layer for contact with a surface to be cleaned so as to carry out dusting and cleaning.

9 Claims, 10 Drawing Sheets

DUSTING DEVICE

BACKGROUND OF THE INVENTION

1. Technical Field

The present invention relates to a dusting device and, more particularly, to a detachable dusting device which can be rapidly connected to and detached from a cleaning machine and which is capable of dusting, cleaning, and polishing.

2. Description of Related Art

One of the most effective approaches to making the floor clean and shiny is to polish with wax. However, the conventional polishing process is time-consuming and laborious, for it is necessary to wax the floor and then polish the waxed floor manually to remove any excessive wax. In addition, it is crucial to clean the floor surface thoroughly before waxing, and yet the traditional cleaning method of sweeping and/or mopping is oftentimes not as effective as expected.

To increase the efficiency of the prerequisite cleaning step, automatic cleaning machines which collect dust by suction were developed. These machines are configured to suck in dust from the bottom (i.e., to vacuum-clean) while moving, or are equipped with a bristled tool for brushing the floor being vacuum-cleaned. A traditional cleaning machine typically operates on a built-in motor, which drives a rotary disc into rotation. The rotary disc is peripherally provided with plural bundles of bristles, generally made of nylon. Once the rotary disc starts rotating, the bristles in contact with the floor sweep, clean, and polish the floor. However, the bristles do not work effectively and tend to leave scratches on the floor. An improved rotary disc, therefore, includes plural strips of cloth in place of bristles. When rotated, the rotary disc drives the strips of cloth to provide an enhanced cleaning or polishing effect. Since the strips of cloth are fixed to the rotary disc, the entire rotary disc must be detached in order to wash the strips. Moreover, the rotary disc itself must not come into contact with water while the strips are washed, and this makes it difficult to wash the strips. In addition, the strips are likely to fall off when rotated and, if happening, will hinder the floor cleaning process. Also, the strips alone cannot be replaced after they have been used for a while; the rotary disc must be replaced together with the strips, which incurs a considerable cost. It is hence a pressing issue for the related industry to device a cleaning element for use with a cleaning machine, wherein the cleaning element can be washed and replaced with ease and be rapidly assembled to the rotary disc of the cleaning machine in a detachable manner.

BRIEF SUMMARY OF THE INVENTION

It is an objective of the present invention to provide a dusting device whose dusting element and rotary disc can be rapidly put together by a mounting or affixing means to facilitate washing, maintenance, or replacement of the dusting element.

Another objective of the present invention is to provide a dusting device which can dust effectively and polish at the same time to reduce the labor required and to avoid scratches on the surface being cleaned.

To achieve the foregoing objectives, the present invention provides a dusting device to be rotatably connected to the bottom of a cleaning machine, wherein the dusting device includes a rotary disc and a dusting element. The rotary disc includes a base with at least one pivotal connection hole to be pivotally connected with the bottom of the cleaning machine so that the rotary disc can be driven to rotate in a horizontal plane by a motor in the cleaning machine. The rotary disc also includes a connecting portion lying below the base and extending outward from the periphery of the base. The bottom surface of the connecting portion forms a pressing plate. The dusting element is detachably assembled to the connecting portion of the rotary disc in order to be pressed by the pressing plate. The dusting element includes at least one cleaning layer for contact with and for cleaning and polishing a surface to be cleaned.

According to a preferred embodiment of the present invention, the dusting element is bag-shaped and includes a mounting opening. The mounting opening is peripherally provided with an elastic element to enable expansion and contraction of the mounting opening so that the dusting element can be mounted around the connecting portion of the rotary disc.

According to another preferred embodiment of the present invention, the connecting portion is integrally formed with the base such that the connecting portion and the base jointly have a continuous curved cross section. Further, the connecting portion is formed along the periphery of the base and is flexible in order to withstand the reaction force of the surface to be cleaned when the connecting portion is pressed on the surface to be cleaned.

According to yet another preferred embodiment of the present invention, the dusting element further includes a plurality of notches extending inward from the periphery of the dusting element and arranged in a spaced manner along the periphery of the dusting element, and the dusting element can provide dusting, cleaning, and polishing at the same time.

The dusting element of the dusting device of the present invention can be rapidly mounted around or affixed to the rotary disc in order to both dust and polish by means of the properties of the fibrous material of the dusting element. The dusting element can also be conveniently and rapidly detached from the rotary disc to facilitate washing or replacement. In addition, the structurally improved rotary disc can be easily detached from the cleaning machine for maintenance and repair. Thus, the dusting device of the present invention effectively solves the problems associated with the conventional cloth strips or bristles, namely the difficulties one may encounter when trying to detach the cloth strips or bristles from the rotary disc and to clean and service such cleaning elements.

DETAILED DESCRIPTION OF THE INVENTION

The dusting device 1 of the present invention is applicable to a conventional automatic or manual cleaning machine (not shown) or vacuum cleaner (not shown), wherein the cleaning machine or vacuum cleaner has a rotating shaft (not shown) at the bottom. The rotating shaft is configured for pivotal connection with the dusting device 1 so that the dusting device 1 can be driven to rotate by a motor in the cleaning machine or vacuum cleaner via the rotating shaft.

Figure 1:
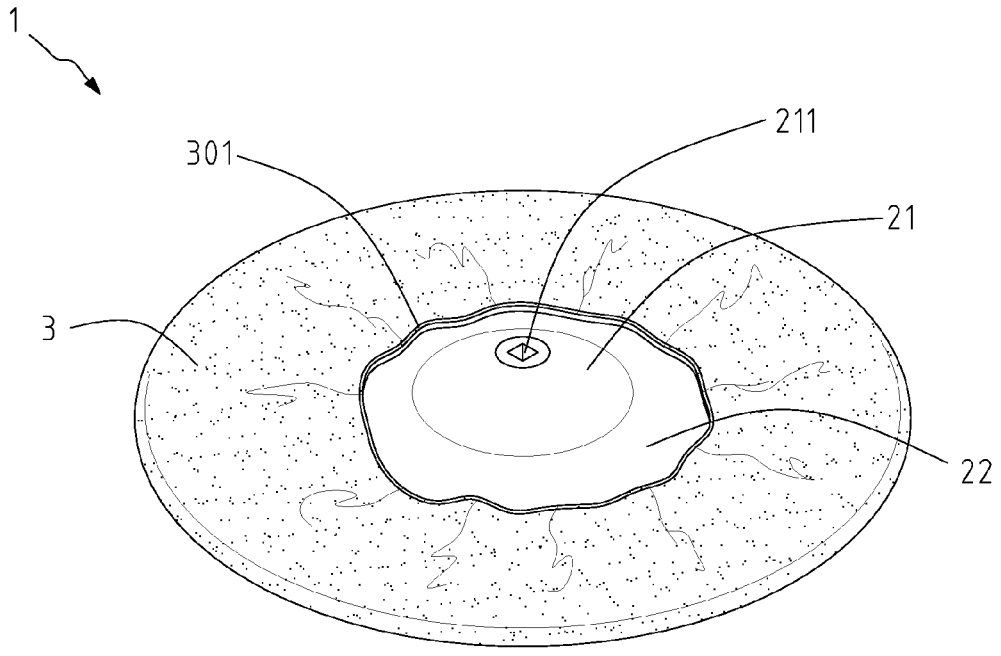
FIG. 1 is an assembled perspective view of the dusting device in the first embodiment of the present invention.
Figure 2:
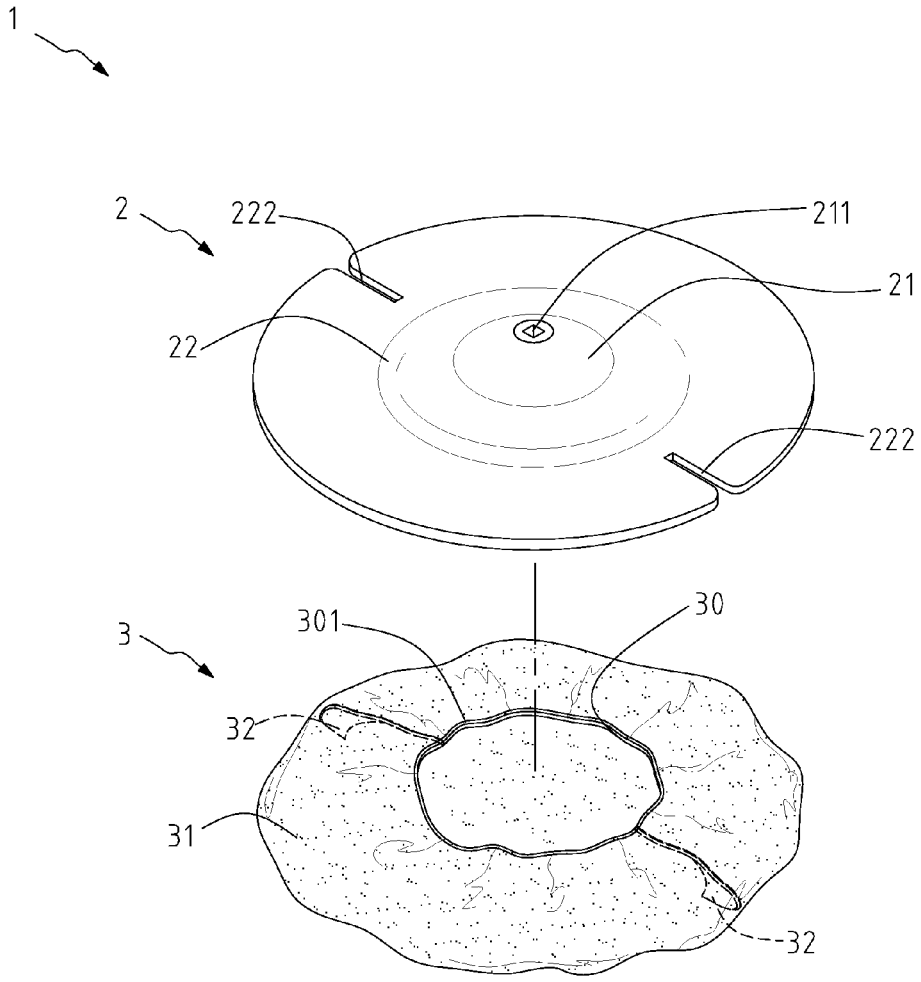
FIG. 2 an exploded perspective view of the dusting device in FIG. 1.
Figure 3:
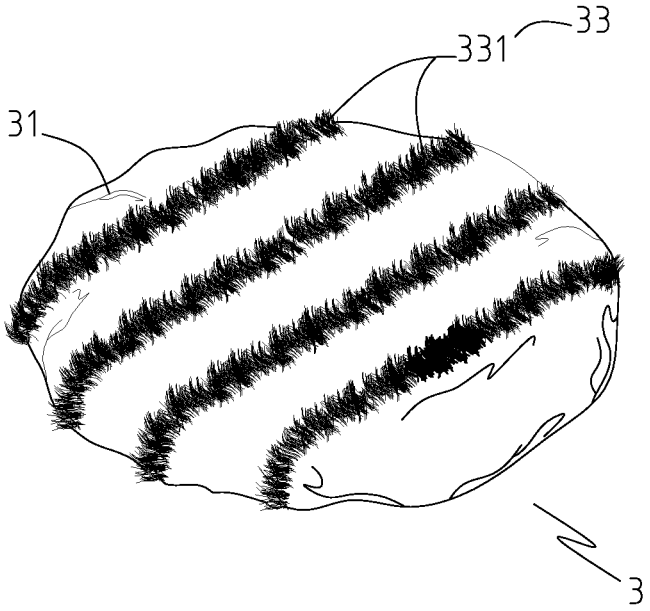
FIG. 3 is a bottom perspective view of the dusting element of the dusting device in FIG. 1.
Figure 4:
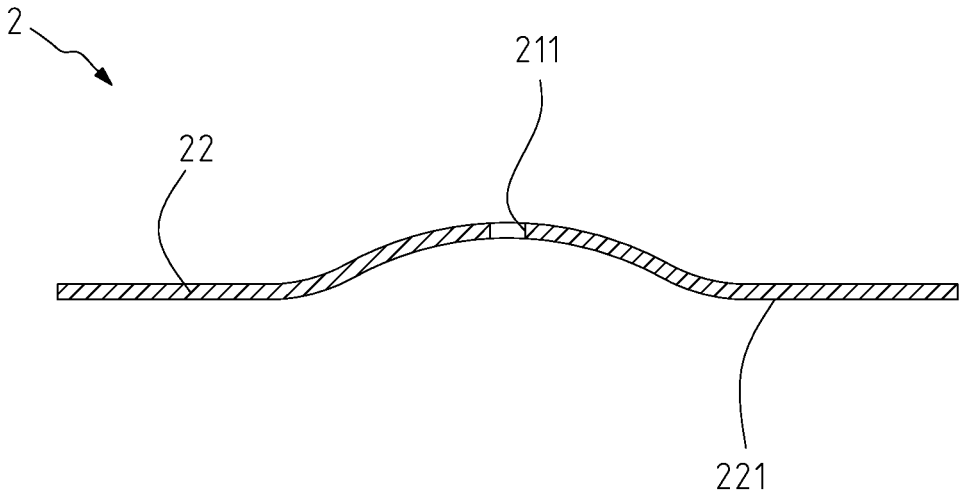
FIG. 4 is a schematic sectional view of the rotary disc of the dusting device in FIG. 1.

Referring to FIG. 1 to FIG. 4, the first preferred embodiment of the dusting device 1 includes a rotary disc 2 and a dusting element 3. The rotary disc 2 includes a base 21 and a connecting portion 22. In this embodiment, the connecting portion 22 is integrally formed with the base 21 by injection molding. The base 21 has a pivotal connection hole 211 to be pivotally connected to the rotating shaft at the bottom of the cleaning machine, in order for the motor in the cleaning machine to drive the rotary disc 2 into rotation in a horizontal plane. Pivotal connection between the pivotal connection hole 211 and the cleaning machine can be achieved by a common threaded or fastening means. The connecting portion 22 lies below the base 21 and extends outward from the periphery of the base 21. Consequently, the base 21 and the connecting portion 22 as a whole have a continuous curved cross section, as shown in FIG. 2 and FIG. 4. The connecting portion 22 is formed along the periphery of the base 21 and is flexible so that, when pressed on the surface to be cleaned, the connecting portion 22 can withstand the reaction force of the surface to be cleaned. The bottom surface of the connecting portion 22 forms a pressing plate 221.

It should be pointed out that the dusting element 3 in the first embodiment is bag-shaped and includes a mounting opening 30. The mounting opening 30 is peripherally provided with an elastic element 301 either by a heat melting means or by sewing. The elastic element 301 allows the mounting opening 30 to be enlarged and reduced so that the dusting element 3 can be mounted around the connecting portion 22 of the rotary disc 2. The elastic element 301 in this embodiment can be an elastic ribbon. Please note that at least one pair of interfering walls 32 (see FIG. 2) are provided inside, and at two opposite sides of, the bag-shaped dusting element 3 and are each connected to a top portion and a bottom portion of the inner surface of the bag, and that the pressing plate 221 of the connecting portion 22 of the rotary disc 2 has at least one pair of positioning grooves 222. The positioning grooves 222 are provided in a spaced manner at two opposite sides of the pressing plate 221 respectively, and each positioning groove 222 extends a predetermined distance inward from the periphery of the pressing plate 221. To mount the bag-shaped dusting element 3 around the rotary disc 2 from below, the elastic element 301 is stretched wide open, and then the dusting element 3 is adjusted in position in order to fit the interfering walls 32 into the corresponding positioning grooves 222 respectively. Once the interfering walls 32 are in place, the mounting opening 30 is released, allowing the elastic element 301 to tighten on the connecting portion 22 and thereby conclude the assembly process. The pivotal connection hole 211 of the base 21 can now be pivotally connected to the cleaning machine so that dusting and polishing can be carried out. The bag-shaped dusting element 3 further includes at least one cleaning layer 31, which is the outer surface of the bag and is designed for direct contact with the surface to be cleaned. The cleaning layer 31 can be made of a non-woven material.

When the dusting device 1 in this embodiment is in use, the rotary disc 2 is driven to rotate horizontally around 360 degrees by the cleaning machine, and the cleaning layer 31 produces an enhanced dusting effect and also a polishing effect due to its material properties. In another embodiment, the cleaning layer 31 of the dusting element 3 is further provided with a plurality of super-fiber strips 33. Each fiber strip 33 is provided with a plurality of dusting fibers 331 (see FIG. 3) whose free ends can move freely for an enhanced dusting, cleaning, and water-absorbing effect. The dusting fibers 331 can be made of feather yarn or fancy yarn.

Figure 5:
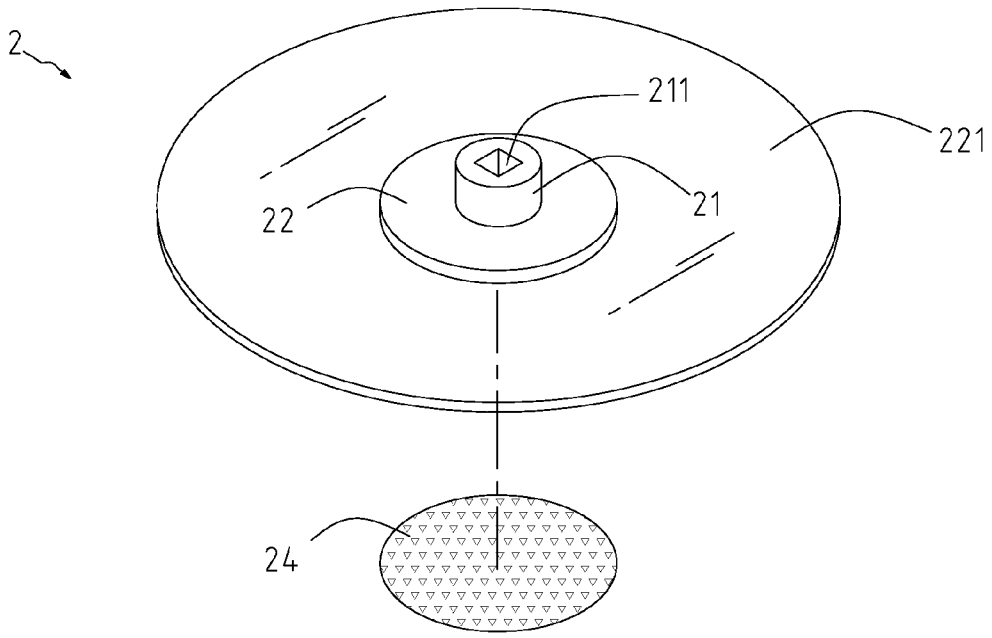
FIG. 5 is an exploded perspective view of the rotary disc of the dusting device in the second embodiment of the present invention.
Figure 6A:
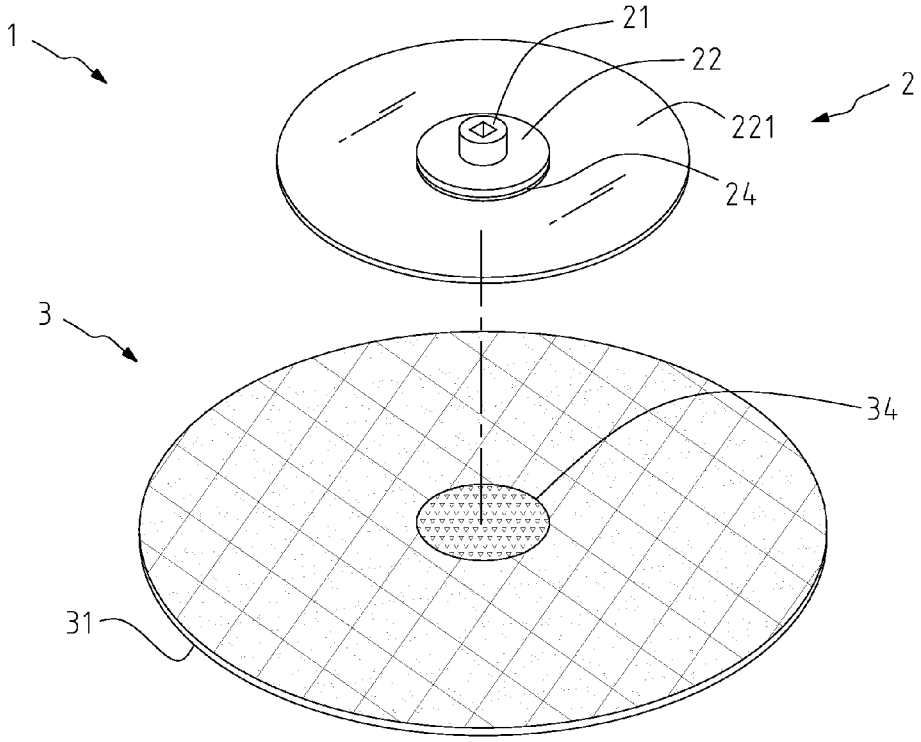
FIG. 6A is an exploded perspective view of the dusting device in the second embodiment of the present invention.
Figure 6B:
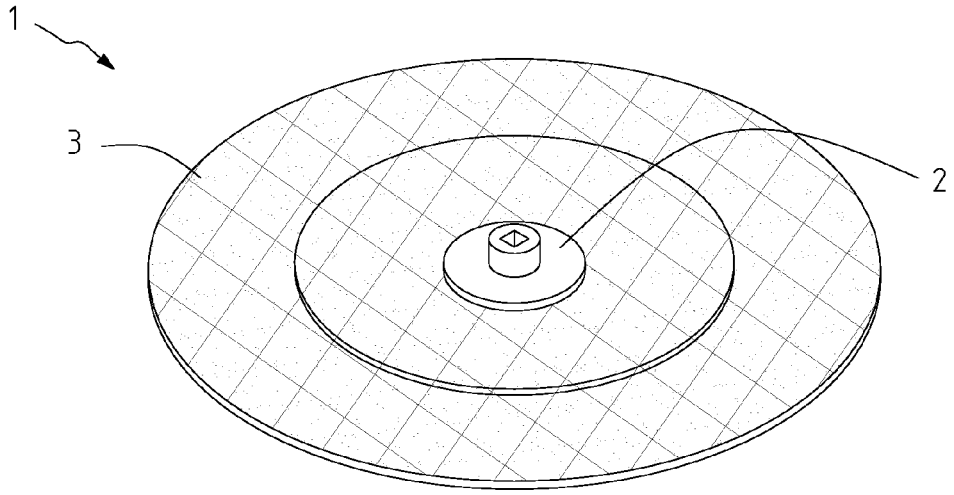
FIG. 6B is an assembled perspective view of the dusting device in FIG. 6A.

FIG. 5, FIG. 6A, and FIG. 6B show the second embodiment of the dusting device 1 of the present invention. In this embodiment, the rotary disc 2 also has a base 21 and a connecting portion 22, and yet the bottom surface of the connecting portion 22 is provided with an affixing layer 24 having a hook-and-loop affixing structure generally known as Velcro. The dusting element 3 in this embodiment is a circular plate and also has a cleaning layer 31 on one side. On the opposite side of the cleaning layer 31, however, there is an affixing portion 34. The affixing portion 34 is located at the center of the dusting element 3, corresponds to the affixing layer 24 of the rotary disc 2, and has a corresponding affixing structure. As the plate-shaped dusting element 3 can be directly affixed to the affixing layer 24 of the connecting portion 22 via the affixing portion 34, connection between the rotary disc 2 and the dusting element 3 can be rapidly accomplished with ease.

Figure 7:
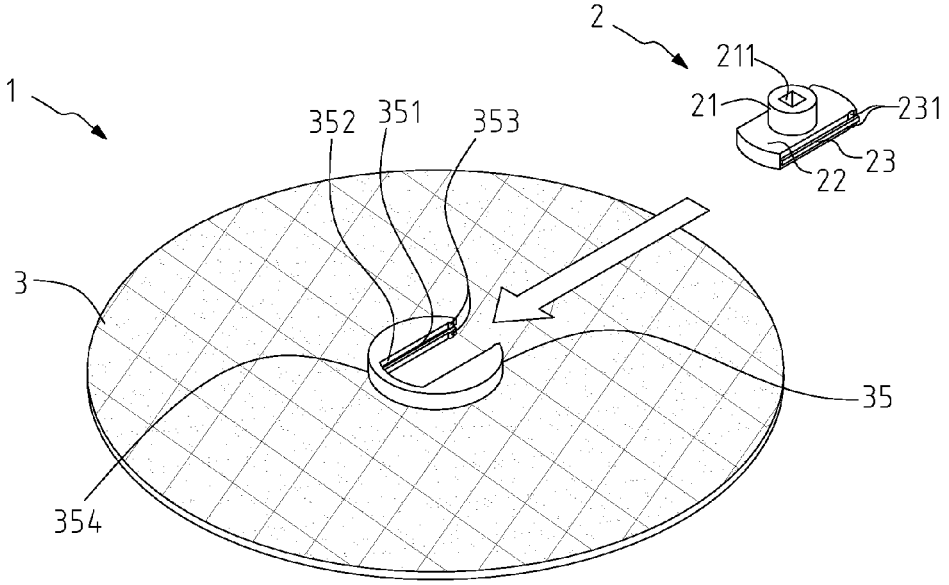
FIG. 7 is an exploded perspective view of the dusting device in the third embodiment of the present invention.
Figure 8:
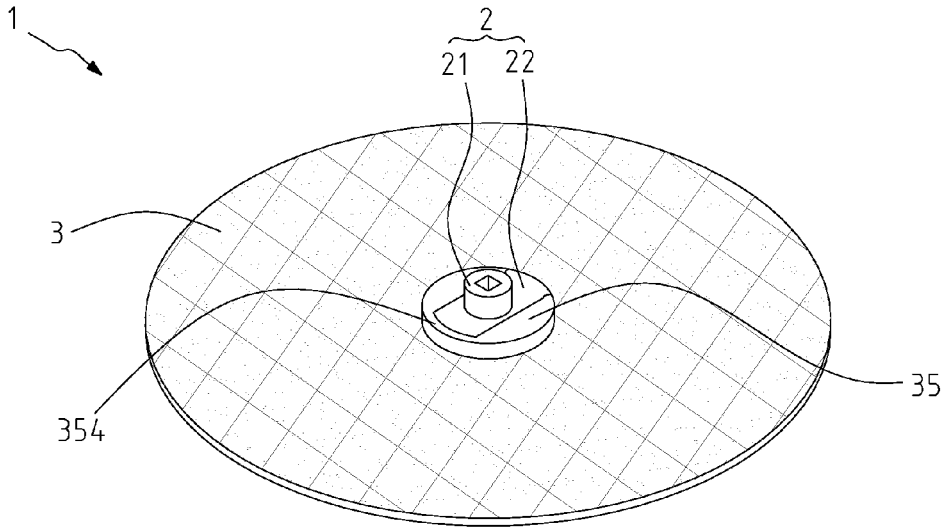
FIG. 8 is an assembled perspective view of the dusting device in FIG. 7.

FIG. 7 and FIG. 8 show the third embodiment of the dusting device 1 of the present invention. In this embodiment, the dusting element 3 is also a circular plate but is centrally provided with a fastening portion 35 by a heat melting means. The dusting element 3 also has a cleaning layer 31 for dusting and polishing. The fastening portion 35 protrudes from the surface of the dusting element 3 and includes a track 351. The track 351 is open at one end and has two opposite sides each concavely provided with an engaging groove 352. The pair of engaging grooves 352 extend along the length of the track 351. Moreover, the connecting portion 22 of the rotary disc 2 is provided with a pair of engaging members 23 which correspond respectively to the pair of engaging grooves 352 and which protrude from two opposite sides of the connecting portion 22 respectively. Thus, the connecting portion 22 can be slid into the track 351 from the open end of the track 351. This transverse sliding connection mechanism helps reduce the overall thickness of the cleaning machine. Furthermore, the rotary disc 2 and the dusting element 3 are connected together by engagement between the pair of engaging members 23 of the rotary disc 2 and the pair of engaging grooves 352. Besides, the end of the track 351 that is opposite where the engaging members 23 are inserted is provided with a position-limiting wall 354 for limiting the sliding motion of the connecting portion 22 at the end of the track 351. In addition, the track 351 is provided with at least one projection 353 in the vicinity of each of the upper and lower sides of each engaging groove 352, and the connecting portion 22 is provided with recesses 231 corresponding respectively to the projections 353. When the connecting portion 22 has been slid to the predetermined position in the track 351, the recesses 231 are securely engaged with the projections 353 respectively. Therefore, the rotary disc 2 is not only longitudinally positioned by engagement between the engaging grooves 352 and the engaging members 23, but also transversely positioned by the position-limiting wall 354 and by interference between the recesses 231 and the projections 353. This ensures secure connection between the dusting element 3 and the rotary disc 2.

Figure 9:
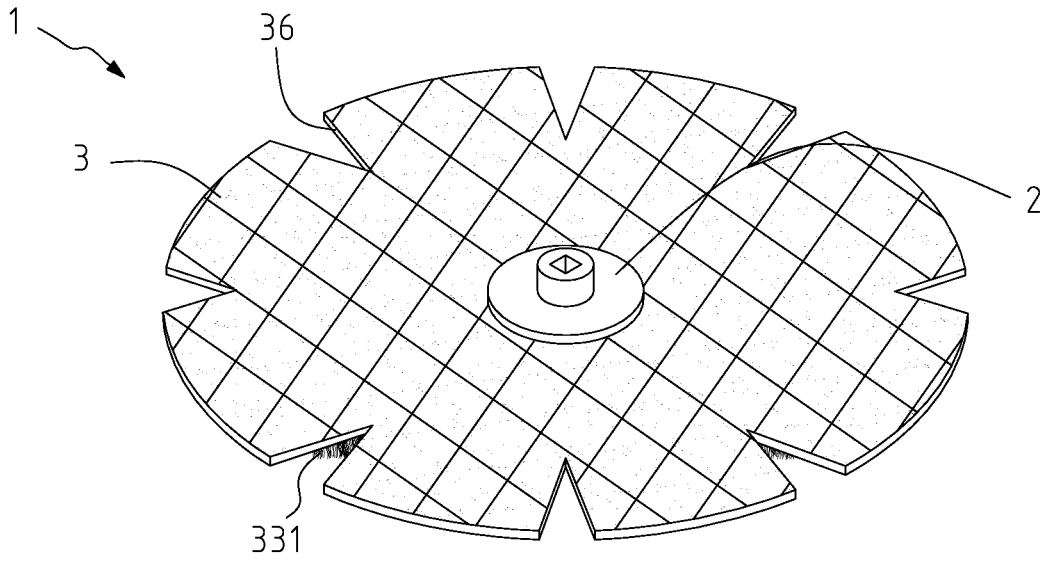
FIG. 9 is a perspective view of another embodiment of the dusting element in the present invention.

FIG. 9 shows another embodiment of the dusting element 3 of the present invention. In this embodiment, the dusting element 3 is a circular plate and includes a plurality of notches 36. The notches 36 extend inward from the periphery of the dusting element 3 and are equally spaced along the periphery of the dusting element 3 such that the plate-shaped dusting element 3 has petal-like sections. The notches 36 provide more space for contact with dust particles when the dusting element 3 is rotated, and the dust particles will be swept into the bottom of the cleaning machine or vacuum cleaner by rotation of the dusting element 3 to facilitate dust collection by the cleaning machine or vacuum cleaner. The cleaning layer 31 of the dusting element 3 may also be provided with the aforesaid dusting fibers 331.

It is worth mentioning that the pressing plate 221 shown in FIG. 4 may also be incorporated into the embodiments in FIG. 5 and FIG. 7. More specifically, the periphery of the connecting portion 22 in FIG. 5 may extend radially outward to form the pressing plate 221 for pressing the plate-shaped dusting element 3.

In summary of the above, the dusting device 1 of the present invention includes a dusting element 3 which can be rapidly mounted or affixed to the rotary disc 2 and which, by virtue of its material properties, can produce an enhanced dusting effect and a polishing effect simultaneously. When the dusting element 3 is rotated by the spinning rotary disc 2, dust particles on the surface to be cleaned are collected by the dusting element 3 and hence removed, and the surface to be cleaned is polished at the same time. Moreover, the dusting element 3 of the present invention can be conveniently and rapidly detached from the rotary disc 2 in order to be washed or replaced. The rotary disc 2, too, can be readily detached from the cleaning machine to facilitate maintenance and repair, thanks to the improved disc structure. Thus, the dusting device 1 of the present invention effectively solves the problems of its prior art counterparts, i.e., the difficulties of detaching the conventional cloth strips or bristles from the rotary disc and of washing and servicing these conventional cleaning elements.

What is claimed is:

1. A dusting device, rotatably connectable to a bottom of a cleaning machine, the dusting device comprising a rotary disc and a dusting element, the rotary disc comprising:

a base having at least one pivotal connection hole for pivotal connection with the bottom of the cleaning machine so that the rotary disc can be driven to rotate in a horizontal plane by a motor in the cleaning machine; and a connecting portion provided below the base and extending outward from a periphery of the base, the connecting portion having a bottom surface forming a pressing plate;

wherein the dusting element is detachably assembled to the connecting portion of the rotary disc in order to be pressed by the pressing plate, and the dusting element comprises at least one cleaning layer for contact with a surface to be cleaned in order to carry out dusting and cleaning, the dusting element further comprises a plurality of notches extending inward from a periphery of the dusting element and arranged in a spaced manner along the periphery of the dusting element, and the dusting element can carry out dusting, cleaning, and polishing simultaneously.

2. The dusting device of claim 1, wherein the dusting element is bag-shaped and comprises a mounting opening, and the mounting opening is peripherally provided with an elastic element for enlarging and reducing the mounting opening so that the dusting element can be mounted around the connecting portion of the rotary disc.

3. The dusting device of claim 2, wherein the pressing plate of the connecting portion has at least one pair of positioning grooves provided in a spaced manner at two opposite sides of the pressing plate respectively, each said positioning groove extends a predetermined distance inward from a periphery of the pressing plate, at least one pair of interfering walls formed inside the bag-shaped dusting element, and the pair of interfering walls correspond to and are engageable with the pair of positioning grooves respectively.

4. The dusting device of claim 1, wherein the cleaning layer of the dusting element is provided with a plurality of super-fiber strips, each said fiber strip is provided with a plurality of dusting fibers, each said dusting fiber has a free end freely movable to carry out dusting and cleaning, the cleaning layer is made of a non-woven material, and the dusting fibers are made of feather yarn or fancy yarn.

5. The dusting device of claim 1, wherein the bottom surface of the connecting portion of the rotary disc is provided with an affixing layer, and the dusting element has a side opposite the cleaning layer and provided with an affixing portion so that the dusting element can be directly affixed to the affixing layer of the connecting portion via the affixing portion.

6. A dusting device, rotatably connectable to a bottom of a cleaning machine, the dusting device comprising a rotary disc and a dusting element, the rotary disc comprising:

a base having at least one pivotal connection hole for pivotal connection with the bottom of the cleaning machine so that the rotary disc can be driven to rotate in a horizontal plane by a motor in the cleaning machine; and a connecting portion provided below the base and extending outward from a periphery of the base, the connecting portion having a bottom surface forming a pressing plate;

wherein the dusting element is detachably assembled to the connecting portion of the rotary disc in order to be pressed by the pressing plate, and the dusting element comprises at least one cleaning layer for contact with a surface to be cleaned in order to carry out dusting and cleaning, the connecting portion is integrally formed with the base such that the connecting portion and the base have a continuous curved cross section, and the connecting portion is formed along the periphery of the base and is flexible in order to withstand a reaction force of the surface to be cleaned when the connecting portion is pressed on the surface to be cleaned.

7. A dusting device, rotatably connectable to a bottom of a cleaning machine, the dusting device comprising a rotary disc and a dusting element, the rotary disc comprising:

a base having at least one pivotal connection hole for pivotal connection with the bottom of the cleaning machine so that the rotary disc can be driven to rotate in a horizontal plane by a motor in the cleaning machine; and a connecting portion provided below the base and extending outward from a periphery of the base, the connecting portion having a bottom surface forming a pressing plate;

wherein the dusting element is detachably assembled to the connecting portion of the rotary disc in order to be pressed by the pressing plate, and the dusting element comprises at least one cleaning layer for contact with a surface to be cleaned in order to carry out dusting and cleaning, the dusting element is plate-shaped and is provided with a fastening portion, the fastening portion is provided at a central portion of the dusting element by a heat melting means and comprises a track, the track has at least one open end and is concavely provided with a pair of engaging grooves at two opposite sides of the track respectively, the connecting portion of the rotary disc is provided with a pair of engaging members corresponding to the pair of engaging grooves respectively, and the connecting portion is slidable into the track so that the pair of engaging members are engaged with the pair of engaging grooves respectively to connect the rotary disc to the dusting element.

8. The dusting device of claim 7, wherein the fastening portion protrudes from a surface of the dusting element, the pair of engaging members protrude from two opposite sides of the connecting portion respectively, and the track has an end where the engaging members are to be inserted and an opposite end provided with a position-limiting wall for limiting sliding motion of the connecting portion with respect to the track.

9. The dusting device of claim 7, wherein the track is provided with at least one projection in a vicinity of each of an upper side and a lower side of each said engaging groove, and the connecting portion is provided with recesses corresponding to and securely engageable with the projections respectively.

* * * * *